United States Patent [19]

Brachert

[11] Patent Number: 4,459,965

[45] Date of Patent: Jul. 17, 1984

[54] CONTROL INSTALLATION FOR AN EXHAUST GAS FEEDBACK SYSTEM

[75] Inventor: Thomas Brachert, Wiernsheim, Fed. Rep. of Germany

[73] Assignee: Dr. Ing. h.c.F. Porsche AG, Stuttgart, Fed. Rep. of Germany

[21] Appl. No.: 492,192

[22] Filed: May 6, 1983

[30] Foreign Application Priority Data

May 11, 1982 [DE] Fed. Rep. of Germany ..... 3217608

[51] Int. Cl.[3] ..... F02M 25/06; F02D 21/08

[52] U.S. Cl. ..... 123/571; 123/568

[58] Field of Search ..... 123/568, 569, 571, 570

[56] References Cited

U.S. PATENT DOCUMENTS

| | | | |
|---|---|---|---|
| 4,024,847 | 5/1977 | Koganemaru | 123/571 |
| 4,134,376 | 1/1979 | Tokoshima et al. | 123/568 |
| 4,164,208 | 8/1979 | Okitsu et al. | 123/571 |
| 4,171,688 | 10/1979 | Takahashi | 123/571 |
| 4,174,027 | 11/1979 | Nakazumi | 123/568 |

*Primary Examiner*—Wendell E. Burns

*Attorney, Agent, or Firm*—Craig & Burns

[57] ABSTRACT

A control installation for the feedback of exhaust gases, in which two adjusting valves are built into the feedback line in parallel to one another; the two adjusting valves are controlled by a three-way electric shifting valve which is actuated by a pressure sensor connected to the suction line, in such a manner that at lower engine loads, only one adjusting valve is opened whereas at higher engine loads, both adjusting valves are opened.

6 Claims, 2 Drawing Figures

CONTROL INSTALLATION FOR AN EXHAUST GAS FEEDBACK SYSTEM

Figure 1:
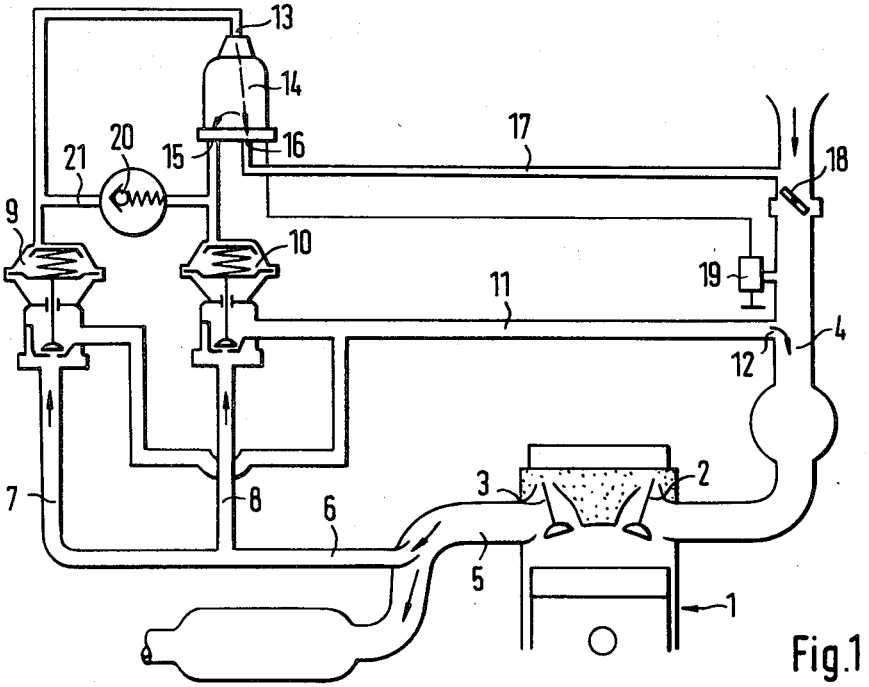

The present invention relates to a control installation for the feedback of exhaust gases into the suction line of a piston internal combustion engine.

Such an exhaust gas feedback system is disclosed in the German Gebrauchsmuster No. 73 17 531. The exhaust gas feedback valve is connected by way of an electric shifting valve to the suction line of the internal combustion engine within the area where the throttle valve is installed (advance bore). If, during the opening of the throttle valve, the electric shifting valve is shifted over by a throttle valve switch, the exhaust gas feedback valve acted upon by the vacuum of the suction pipe can open and permits a corresponding exhaust gas quantity to flow back into the suction line.

It is thereby disadvantageous with this prior art arrangement that at higher engine loads and lesser vacuum of the suction line, the fed-back exhaust gas quantity is reduced so that the exhaust gas feedback becomes ineffectual particularly within that range where it is needed by reason of the high $No_x$-proportion.

The object of the present invention resides in providing an exhaust gas feedback system which is capable of still functioning also at high engine loads, at which the suction pipe vacuum approaches the atmospheric pressure, and which enables a fine feel control of the exhaust gas feedback quantity over the entire load range.

The underlying problems are solved according to the present invention in that a second adjusting valve is connected in parallel with the adjusting valve in the feed-back line and that both adjusting valves are controlled by a three-way shifting valve which is adapted to be shifted by a pressure sensor connected to the suction line. If two adjusting valves are installed into the return line or feedback line for the control of the exhaust gas quantity, then they can be so controlled that at lower engine loads only one is opened whereas at higher engine loads both are opened and therewith a correspondingly larger passage or flow cross section is opened up for the exhaust gas to be fed back. If only one exhaust gas feedback valve were used in the known manner and the through-flow cross section thereof were dimensioned so large that it is equal to the total cross section of two valves, then this valve could be controlled only poorly within the lower range since a large difference of the passage or flow cross section would correspond to a small valve stroke and one would therefore have to work with extremely small valve strokes for metering the feedback quantity. The exhaust gas feedback system according to the present invention is particularly advantageous for internal combustion engines which for consumption reasons are operated in the CVS test with low engine rotational speeds but with a high load. It assures a readily controllable exhaust gas feedback also with a fully opened throttle valve.

According to a further feature of the present invention, a three-way electric shifting valve is used as shifting valve, which is adapted to be shifted from the one into the other passage position by a pressure sensor constructed as a switch. The shifting point responding to vacuum can be accurately adjusted at the pressure sensor which is connected to the suction line between throttle valve and inlet valve, and can be readily matched to the operating condition of the respective internal combustion engine.

Figure 2:
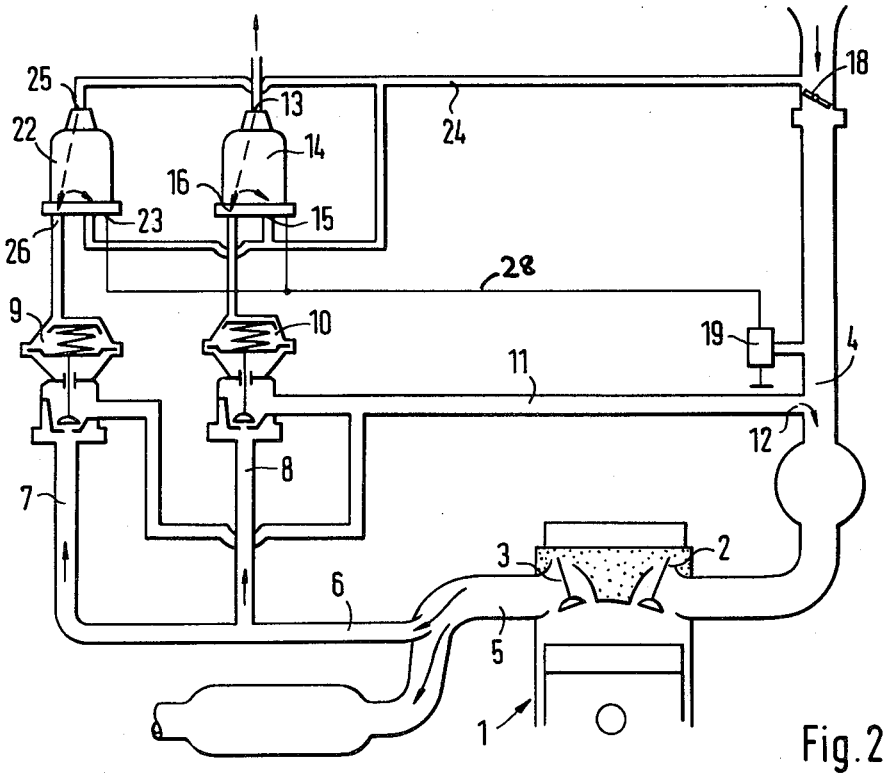

These and other objects, features and advantages of the present invention will become more apparent from the following description when taken in connection with the accompanying drawing which shows, for purposes of illustration only, two embodiments in accordance with the present invention, and wherein:

FIG. 1 is a schematic view of an exhaust gas feedback system in accordance with the present invention; and FIG. 2 is a schematic view of a modified embodiment of an exhaust gas feedback system in accordance with the present invention.

Referring now to the drawing wherein like reference numerals are used throughout the two views to designate like parts, a piston internal combustion engine 1 having an inlet valve 2 and an exhaust valve 3 is provided with a suction line 4 and an exhaust gas line 5, from which branches off a feedback line 6. Two adjusting valves 9 and 10 are built into two parallel, partial sections 7 and 8 of the feedback line 6. Downstream of the adjusting valves 9 and 10, the exhaust gas is conducted in a common collecting line 11 to a location 12 in the suction line 4. The one adjusting valve 9 is connected with the head-end connection 13 of a shifting valve 14, for which a three-way electric shifting valve is used. The adjusting valve 10 is connected to one end-face connection 15 of the shifting valve 14 whereas the other end-face connection 16 of the shifting valve is in communication by way of a line 17 with a suction line 4 at the location where the throttle valve 18 is installed.

A pressure sensor 19 which is connected to the suction line 4 between the throttle valve 18 and the connecting place 12 of the exhaust gas feedback is constructed as electrical switch for the shifting valve 14.

As long as the switch of the pressure sensor 19 is closed and the shifting valve 14 is energized, the connections 13 and 16 thereof are in communication with each other (indicated by the dash line with the arrow). The vacuum prevailing at the throttle valve 18 acts on the spring-loaded diaphragm of the adjusting valve 9 and opens up at the adjusting valve 9 a correspondingly large passage or flow cross section for the exhaust gases to be fed back. An actuation of the adjusting valve 10 is prevented by the check valve 20 which is installed into the control line 21 from the adjusting valve 9 to the adjusting valve 10. If, beginning with a predetermined engine load the switch of the pressure sensor 19 opens and de-energizes the shifting valve 14, the end-face connections 15 and 16 thereof are connected with each other whereas the connection 13, 16 is interrupted (arc with arrow).

In this position, the adjusting valve 9 is actuated and in addition thereto also the adjusting valve 10 is now actuated by way of the now opening check valve 20. Thus, the passage or flow cross sections of the two parallely connected adjusting valves 9 and 10 are available to the exhaust gas return flow. By a suitable dimensioning of the cross sections and of the springs acting on the diaphragms, it can be achieved that the fed-back exhaust gas flow increases with the engine load according to a continuously increasing function when the second adjusting valve is additionally actuated to open up.

According to FIG. 2, each of the two adjusting valves 10 and 9 are controlled by a respective shifting valve 14 and 22 coordinated thereto. The one end-face connections 15, respectively, 23 of the shifting valves 14, respectively, 22 are connected by way of a common control line 24 with the throttle valve 18. The head-end connection 25 of the shifting valve 22 is also connected with the same control line 24 whereas the head-end connection 13 of the shifting valve 14 leads into the atmosphere. The other two end-face connections 16, respectively, 26 of the shifting valve 14, respectively, 22 are in communication with the adjusting valves 10, respectively, 9.

The pressure sensor 19 connected with the suction line 4 is connected with the two shifting valves 14 and 22 by way of an electric line 28. At low engine loads, both shifting valves 14 and 22 are energized; the adjusting valve 9 is opened whereas the adjusting valve 10 is vented by way of the head-end connection 13 of the shifting valve 14 and remains closed. Beginning with a predetermined engine load, the switch of the pressure sensor 19 opens. Both shifting valves 14 and 22 become de-energized so that both adjusting valves 9 and 10 open and exhaust gases can flow back into the suction line 4 by way of the two adjusting valves.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A control installation for the feedback of exhaust gases into the suction line of a piston internal combustion engine, comprising a first adjusting valve means connected into a feedback line means, and shifting valve means operatively connected with the suction line within the area of a throttle valve means for controlling the adjusting valve means, characterized in that a second adjusting valve means is connected in the feedback line means in parallel with the first adjusting valve means, and in that both adjusting valve means are controlled by a three-way shifting valve means which is shiftable by a pressure sensor connected to the suction line.

2. A control installation according to claim 1, characterized in that at low engine loads only the first adjusting valve means is acted upon by the suction pipe vacuum whereas at higher engine loads, after the shifting of the shifting valve means, both adjusting valve means assume an open position corresponding to the vacuum.

3. A control installation according to claim 2, in which line means connect the shifting valve means with the adjusting valve means, characterized in that the line means are connected with each other by a control line which includes a check valve.

4. A control installation according to claim 2, characterized in that one shifting valve means is coordinated to each of the adjusting valve means, the shifting valve means being operable to be controlled by a common pressure sensor.

5. A control installation according to claim 1, in which line means connect the shifting valve means with the adjusting valve means, characterized in that the line means are connected with each other by a control line which includes a check valve.

6. A control installation according to claim 1, characterized in that one shifting valve means is coordinated to each of the adjusting valve means, the shifting valve means being operable to be controlled by a common pressure sensor.

* * * * *